US007369084B2

(12) United States Patent
Liao

(10) Patent No.: US 7,369,084 B2
(45) Date of Patent: May 6, 2008

(54) TWO-SECTIONAL CONTROLLING METHOD AND DEVICE FOR SATELLITE ANTENNA

(75) Inventor: Tao-Ming Liao, Hsinchu (TW)

(73) Assignee: Industrial Technology Research Institute (TW)

( * ) Notice: Subject to any disclaimer, the term of this patent is extended or adjusted under 35 U.S.C. 154(b) by 0 days.

(21) Appl. No.: 11/614,377

(22) Filed: Dec. 21, 2006

(65) Prior Publication Data

US 2008/0036656 A1 Feb. 14, 2008

(30) Foreign Application Priority Data

Aug. 9, 2006 (TW) ..... 95129278 A

(51) Int. Cl.
*H01Q 3/00* (2006.01)

(52) U.S. Cl. ..... 342/359; 342/74

(58) Field of Classification Search ..... 342/74, 342/76, 357.06, 359; 343/754, 757
See application file for complete search history.

(56) References Cited

U.S. PATENT DOCUMENTS

| | | | | |
|---|---|---|---|---|
| 4,035,805 | A * | 7/1977 | Mobley | 342/426 |
| 6,208,307 | B1 * | 3/2001 | Frisco et al. | 343/757 |
| 7,095,376 | B1 * | 8/2006 | Timothy et al. | 343/705 |
| 7,136,751 | B2 * | 11/2006 | Pinto et al. | 701/215 |
| 7,221,316 | B2 * | 5/2007 | O'Brien et al. | 342/358 |

* cited by examiner

*Primary Examiner*—Dao Phan
(74) *Attorney, Agent, or Firm*—Allen, Dyer, Doppelt, Milbrath & Gilchrist, P.A.

(57) ABSTRACT

A controlling device for a satellite antenna is provided. The controlling device includes a first signal generating device generating an inertial compensating signal having a compensating direction; a second signal generating device assembling a received signal from a satellite and generating an orientation with a strongest satellite signal in responding to a signal received from a satellite; a first driving device receiving the inertial compensating signal and driving the satellite antenna toward the compensating direction in a first speed; and a second driving device electrically connected to the second signal generating device and driving the satellite antenna toward the orientation in a second speed.

18 Claims, 4 Drawing Sheets

TWO-SECTIONAL CONTROLLING METHOD AND DEVICE FOR SATELLITE ANTENNA

FIELD OF THE INVENTION

The present invention relates to a method and device for controlling the satellite antenna, and more particular to a two-sectional method and device for controlling the satellite antenna.

BACKGROUND OF THE INVENTION

In the field of the satellite communication, for keeping the communication continuous, the satellite antenna should be always aimed at the satellite so as to avoid the signal loss and communication interruption. However, the satellite antenna can be disposed not only in a fixed base on the ground, but also in the vehicles, e.g. the airplanes, ships, cars, etc. Specifically in the moving vehicle, the orientation of the satellite antenna thereon will be changed easily, and thus the communication signal will become weaker. Once the communication signal is too weak to be recognized, the communication between the satellite antenna and the satellite will be broken. Therefore, for keeping the communication between the satellite antenna and the satellite, it is very important to control the satellite antenna to trace the satellite's orientation.

The conventional methods for controlling the satellite antenna to trace the satellite include the manual tracing method, the programmable tracing method, the automatic tracing method and the stepping tracing method, wherein the manual tracing method is unable to be used in the mobile communication. The programmable tracing method, which records the orbit of the satellite and uses a program to trace the satellite's orientation, is usually appropriate for a fixed base station on the ground rather than in a mobile communication. The automatic tracing method is more appropriate for the mobile communication, which is performed by finding the satellite's orientation first, and then combining the stepping tracing method or cooperating with the inertial navigating system, based on the signal magnitude, to trace the satellite, Moreover, the conventional device for controlling the satellite antenna to trace the satellite uses a driving motor in each axis of the satellite antenna for driving it to trace the satellite's orientation. Therefore, whether the large-angle motion for fast searching or the small-angle motion for positioning tracing both uses the same motor for driving. Generally, the high-speed property of the motor is different from the low-speed property of the motor, i.e. the motor with the high-speed property hardly drives the micro-range motion and the motor with the low-speed property hardly drives the big-range motion. Hence, while the controlling circuit uses the same gain value, the performance thereof is poor.

In order to overcome the drawbacks in the prior art, a two-sectional controlling method and device for the satellite antenna are provided. The particular design in the present invention can not only keep the satellite antenna aiming at the satellite fast and precisely, but also keep a good and continuous communication. Thus, the invention has the utility for the industry.

SUMMARY OF THE INVENTION

The present invention provides a two-sectional controlling method and device for the satellite antenna for fast and precisely adjusting the satellite antenna to aim at the satellite and obtaining the strongest communication signal while the satellite antenna is moving. In accordance with an aspect of the present invention, a controlling device for a satellite antenna is provided, which includes a first signal generating device generating an inertial compensating signal having a compensating direction, a second signal generating device assembling a received signal from a satellite and generating an orientation with a strongest satellite signal in responding to a signal received from a satellite, a first driving device receiving the inertial compensating signal and driving the satellite antenna toward the compensating direction in a first speed, and a second driving device electrically connected to the second signal generating device and driving the satellite antenna toward the orientation in a second speed.

According to the controlling device for the satellite antenna described above, the satellite antenna is mounted on one of a fixed base and a movable vehicle.

According to the controlling device for the satellite antenna described above, the first signal generating device is one of a gyroscope and an accelerometer.

According to the controlling device for the satellite antenna described above, the first driving device is a high-speed driver.

According to the controlling device for the satellite antenna described above, the second driving device is a high-precision driver.

According to the controlling device for the satellite antenna described above, the first speed is bigger than the second speed.

According to the controlling device for the satellite antenna described above, the first signal generating device is an inertial navigating device mounted in the satellite antenna, and the second signal generating device is a wave assembling device mounted in the satellite antenna.

According to the controlling device for the satellite antenna described above, the first driving device and the second driving device form a driving set disposed on a vertical axis of the satellite antenna.

According to the controlling device for the satellite antenna described above, the first driving device and the second driving device form a driving set disposed on a horizontal axis of the satellite antenna.

According to the controlling device for the satellite antenna described above, the second signal generating device synthesizing the signal received from the satellite for generating the orientation.

In accordance with another aspect of the present invention, a vehicle having a satellite antenna is provided. The satellite antenna includes an inertial navigating device generating an inertial compensating signal having a compensating direction, a wave assembling device synthesizing a signal received from a satellite and generating an orientation with a strongest satellite signal, and a first and a second driving sets disposed on a horizontal and a vertical axes of the satellite antenna respectively, wherein each of the first and the second driving sets comprises a first driving device electrically connected to the inertial navigating device for driving the satellite antenna toward the compensating direction in a first speed according to the inertial compensating signal, and a second driving device electrically connected to the wave assembling device for driving the satellite antenna toward the orientation with the strongest signal in a second speed.

According to the vehicle having the satellite antenna described above, the inertial navigating device is one of a gyroscope and an accelerometer.

According to the vehicle having the satellite antenna described above, the first driving device is a high-speed driver.

According to the vehicle having the satellite antenna described above, the first speed is bigger than the second speed.

In accordance with a further aspect of the present invention, a method for controlling a satellite antenna is provided. The method includes steps of providing a compensating signal for driving and adjusting the satellite antenna toward a satellite in a first speed; assembling a signal received from the satellite and generating an orientation with a strongest satellite signal; and driving and adjusting the satellite antenna toward the orientation in a second speed.

According to the method for controlling the satellite antenna described above, the compensating signal is generated by an inertial navigating device.

According to the method for controlling the satellite antenna described above, the first speed is bigger than the second speed.

The above contents and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purposes of illustration and description only; it is not intended to be exhaustive or to be limited to the precise form disclosed.

Figure 1:
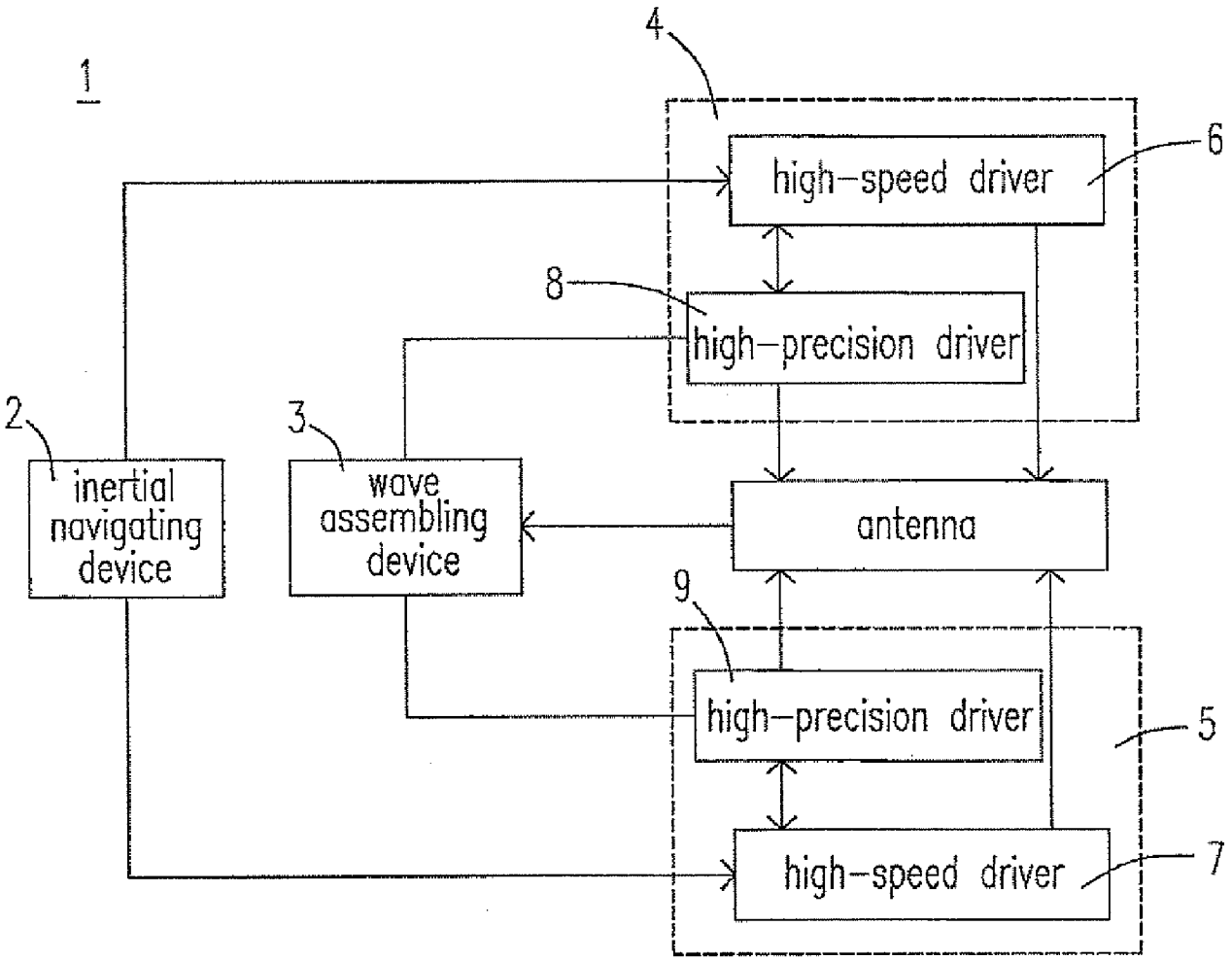
FIG. 1 is a schematic view of the two-sectional controlling device for the satellite antenna according to a preferred embodiment of the present invention.

Please refer to FIG. 1, which shows a schematic view of the two-sectional controlling device for the satellite antenna according to a preferred embodiment of the present invention. The two-sectional controlling device includes a satellite antenna body 1, an inertial navigating device 2, a wave assembling device 3, a horizontal driving set 4, a vertical driving set 5, and an antenna 1.1. The horizontal driving set 4 has a high-speed driver 6 and a high-precision driver 8, while the vertical driving set 5 has a high-speed driver 7 and a high-precision driver 9. The inertial navigating device 2 is disposed in the satellite antenna body 1 and electronically connected to the high-speed drivers 6, 7, and the wave assembling device 3 is disposed in the satellite antenna body 1 and electronically connected to the high-precision drivers 8, 9.

Figure 2A:
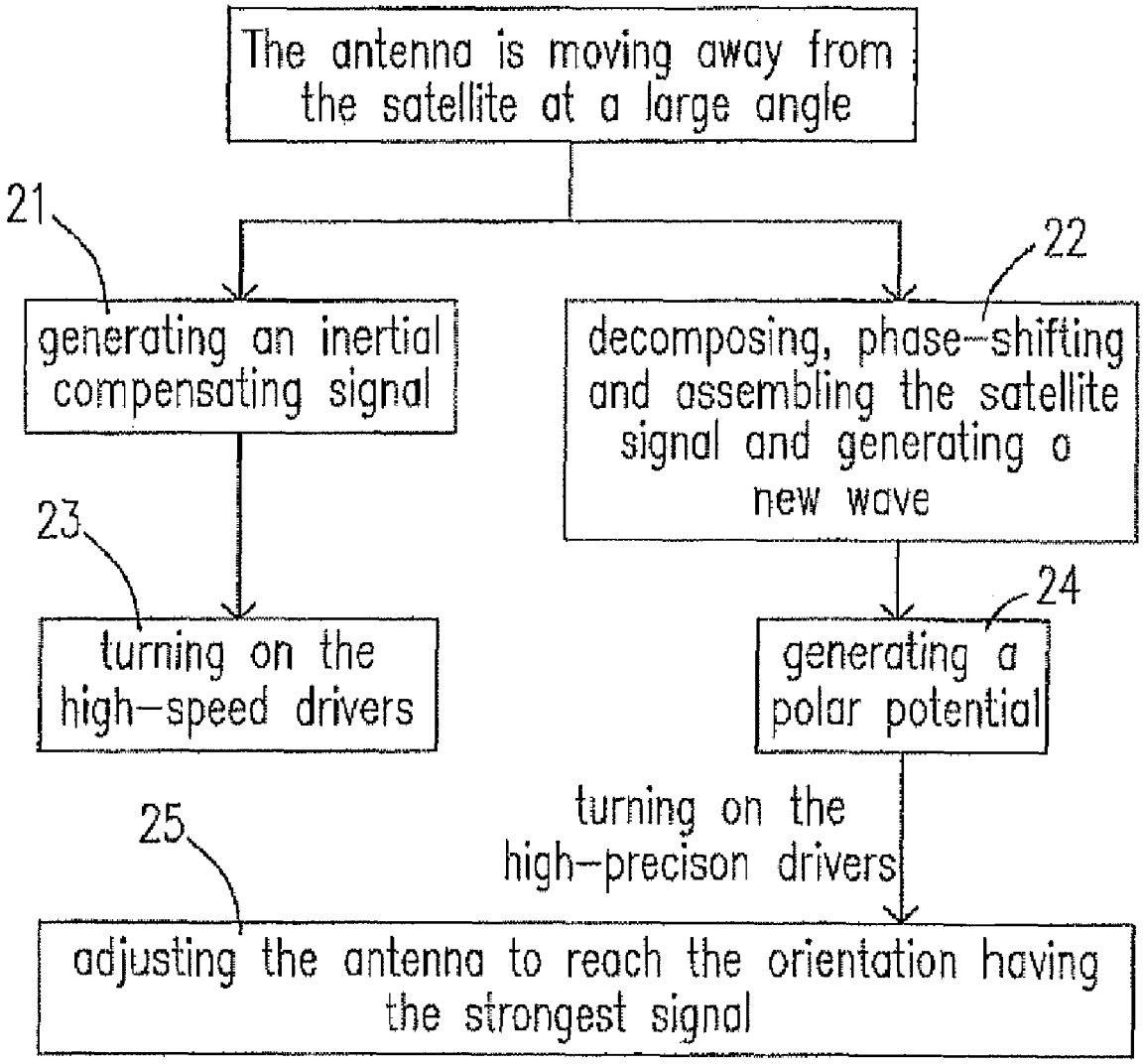
FIGS. 2A and 2B are flow charts of the two-sectional controlling method for the satellite antenna according to a preferred embodiment of the present invention.
Figure 2B:
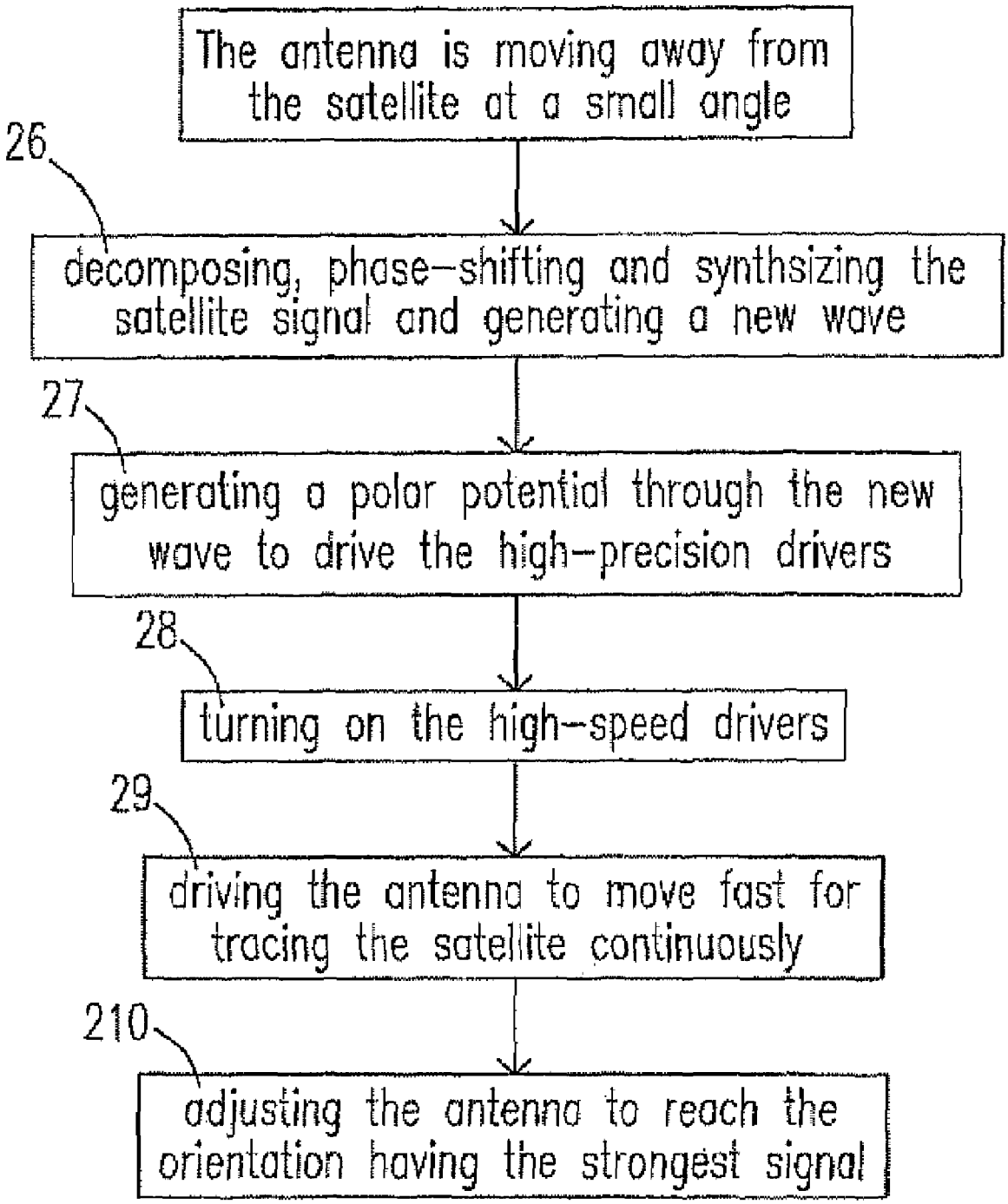
Figure 3:
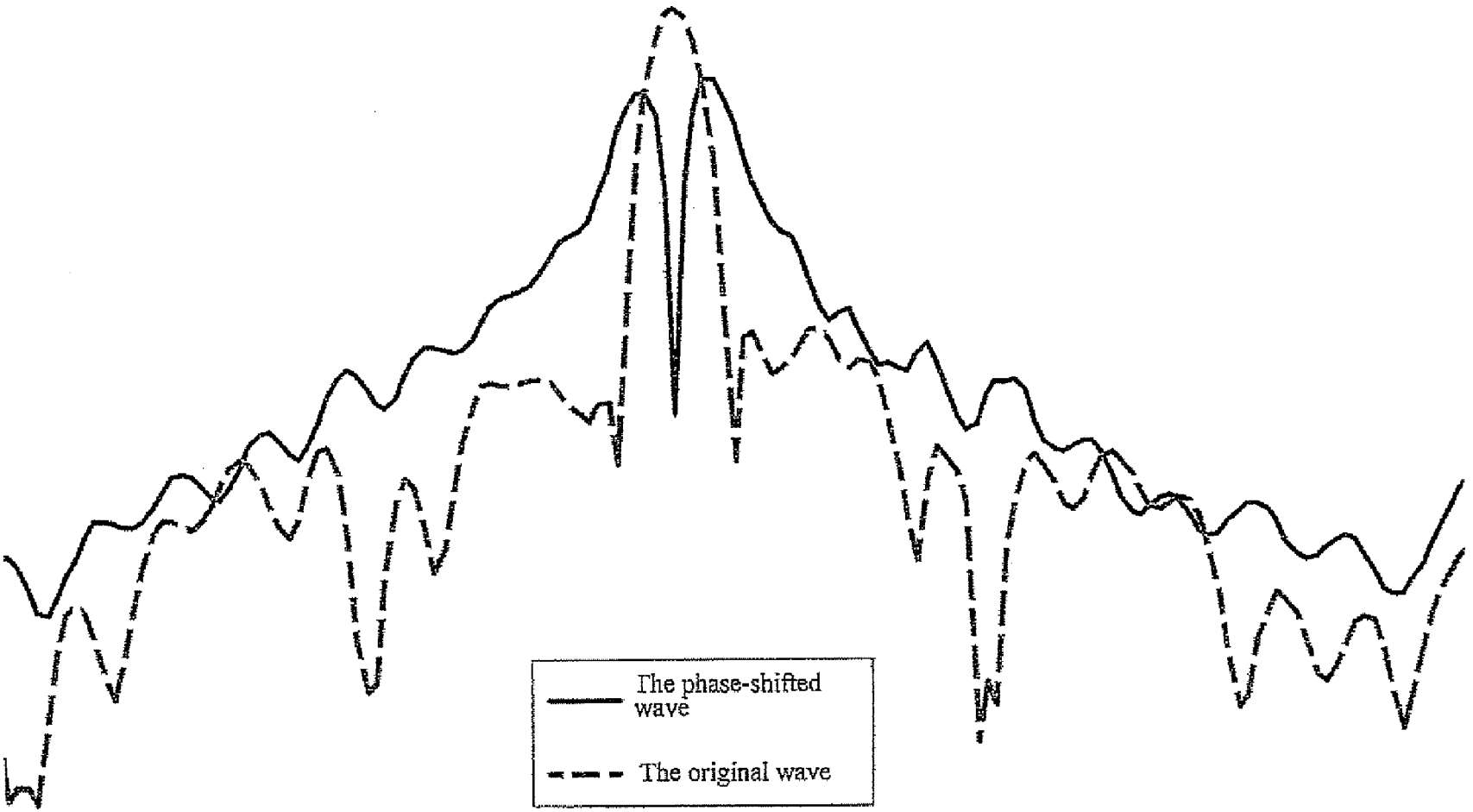
FIG. 3 is a schematic view of the wave synthesized by the wave assembling device of the two-sectional controlling device for the satellite antenna in the present invention.

Please refer to FIGS. 2A and 2B, which are flow charts of the two-sectional controlling method for the satellite antenna according to a preferred embodiment of the present invention. FIG. 2A shows that the antenna 1.1 is moving away from the satellite at a large angle. Firstly, the inertial navigating device 2 detects the change of the antenna's orientation and generates an inertial compensating signal, and the wave assembling device 3 processes the signal wave received from the satellite by decomposing, phase-shifting and synthesizing and generates a new wave, as shown in steps 21 and 22. Then, the high-speed drivers 6, 7 are turned on by the inertial compensating signal to drive the antenna 1.1 to move fast toward a compensating orientation; and the wave assembling device 3 generates a polar potential, as shown in steps 23 and 24. Next, when the antenna 1.1 moves fast to the compensating orientation, the high-precision drivers 8, 9 are turned on by the polar potential to adjust the antenna 1.1 to reach the orientation with the strongest signal, as shown in step 25.

The FIG. 2B shows that the antenna 1.1 is moving away from the satellite at a small angle. Firstly, the wave assembling device 3 processes the signal wave received from the satellite by decomposing, phase-shifting and synthesizing and generates a new wave, as shown in step 26. Then, a polar potential is generated through the new wave to drive the high-precision drivers 8, 9, as shown in step 27. While the running of the high-precision drivers 8, 9 reaches the limitation, the high-speed drivers 6, 7 are turned on, as shown in step 28. Next, the high-speed drivers 6, 7 drive the antenna 1.1 to move fast for tracing the satellite continuously, as shown in step 29. Finally, the high-precision drivers 8, 9 are turned on again for adjusting the antenna 1.1 to reach the orientation with the strongest signal, as shown in step 210.

The present invention is able to be used for a satellite communication system disposed on a vehicle not shown). The vehicle can be selected from one of the plane, ship or car. When the antenna is communicating with the satellite, the antenna should be adjusted corresponding to the direction of the satellite and aim at the orientation with the strongest signal, so as to keep the communication therebetween steady.

The conventional controlling device only uses a driver in the respective vertical axle and horizontal axle for adjusting the orientation of the antenna. If the driver is a high-speed one, it will be hard to aim at the satellite precisely. If the driver is a high-precision one, the antenna will be unable to move fast. However, the two-sectional controlling device of the present invention has a gyroscope or accelerometer which detects the change of the orientation and generates a compensating signal. Then the high-speed drivers in the respective vertical axle and horizontal axle will be turned on and drive the antenna to move toward the direction of the satellite in a high speed in accordance with the compensation signal. Moreover, the wave assembling device decomposes the wave signal received from the satellite and shifts the phase thereof, and then assembles the processed wave and the original wave to generate a new wave. The antenna uses the new wave to analyze the Bore Sight Error of the satellite and transfers the Bore Sight Error into a voltage signal for turning on the piezoelectric components in the respective vertical axle and horizontal axle. The piezoelectric components will be extended while being applied with a positive voltage and will be contracted while being applied with a negative voltage. The piezoelectric devices in the respective vertical axle and horizontal axle adjust the antenna to aim at the orientation with the strongest signal.

The present invention can also be applied to the satellite antenna disposed on a weather station which receives the data from the satellite all the time. When the satellite orbits the globe, the relative position between the satellite and the station changes and the orbit of the satellite is also deviated gradually. Therefore, the strength of the signal from the satellite will vary with the change of the relative position therebetween. Accordingly, the antenna can trace the satellite by searching the strongest signal, so the wave assembling device of the antenna decomposes the wave signal received from the satellite and shifts the phase thereof, and then assembles the processed wave and the original wave to generate a new wave for tracing the satellite. The antenna uses the new wave to analyze the Bore Sight Error of the satellite and transfers the Bore Sight Error into a voltage signal. Then the high-precision motors in the respective vertical axle and horizontal axle are turned on and drive the antenna to move toward the orientation with the strongest signal. While the relative position is too large to adjust by the high-precision motors which causes the performance thereof to reach the limitation, the high-speed motors in the respective vertical axle and horizontal axle are turned on and drive the antenna to move toward the orientation with the strongest signal in a high speed. Until the antenna is close to the orientation with the strongest signal, the high-speed motors will be turned off and the high-precision motors will be turned on again for adjusting the antenna's orientation to aim at the orientation with the strongest signal precisely.

While the invention has been described in terms of what is presently considered to be the most practical and preferred embodiment, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A controlling device for a satellite antenna, comprising:

a first signal generating device generating an inertial compensating signal having a compensating direction;

a second signal generating device assembling a received signal from a satellite and generating an orientation with a strongest satellite signal in responding to a signal received from a satellite;

a first driving device receiving the inertial compensating signal and driving the satellite antenna toward the compensating direction in a first speed and;

a second driving device electrically connected to the second signal generating device and driving the satellite antenna toward the orientation in a second speed.

2. The device as claimed in claim 1, wherein the satellite antenna is mounted on one of a fixed base and a movable vehicle.

3. The device as claimed in claim 1, wherein the first signal generating device is one of a gyroscope and an accelerometer.

4. The device as claimed in claim 1, wherein the second driving device is a high-speed driver.

5. The device as claimed in claim 1, wherein the second driving device is a high-precision driver.

6. The device as claimed in claim 1, wherein the first speed is bigger than the second speed.

7. The device as claimed in claim 1, wherein the first signal generating device is an inertial navigating device mounted in the satellite antenna, and the second signal generating device is a wave assembling device mounted in the satellite antenna.

8. The device as claimed in claim 1, wherein the first driving device and the second driving device form a driving set disposed on a vertical axis of the satellite antenna.

9. The device as claimed in claim 8, wherein the first driving device and the second driving device form a driving set disposed on a horizontal axis of the satellite antenna.

10. The device as claimed in claim 1, wherein the second signal generating device synthesizing the signal received from the satellite for generating the orientation.

11. A vehicle having a satellite antenna comprising:

an inertial navigating device generating an inertial compensating signal having a compensating direction;

a wave assembling device synthesizing a signal received from a satellite and generating an orientation with a strongest satellite signal; and a first and a second driving sets disposed on a horizontal and a vertical axes of the satellite antenna respectively, wherein each of the first and the second driving sets comprises:

a first driving device electrically connected to the inertial navigating device for driving the satellite antenna toward the compensating direction in a first speed according to the inertial compensating signal; and a second driving device electrically connected to the wave assembling device for driving the satellite antenna toward the orientation with the strongest signal in a second speed.

12. The vehicle as claimed in claim 11, wherein the inertial navigating device is one of a gyroscope and an accelerometer.

13. The vehicle as claimed in claim 11, wherein the first driving device is a high-speed driver.

14. The vehicle as claimed in claim 11, wherein the second driving device is a high-precision driver.

15. The vehicle as claimed in claim 11, wherein the first speed is bigger than the second speed.

16. A method for controlling a satellite antenna, comprising steps of:

a. providing a compensating signal for driving and adjusting the satellite antenna toward a satellite in a first speed;

b. assembling a signal received from the satellite and generating an orientation with a strongest satellite signal; and c. driving and adjusting the satellite antenna toward the orientation in a second speed.

17. The method as claimed in claim 16, wherein the compensating signal is generated by an inertial navigating device.

18. The method as claimed in claim 16, wherein the first speed is bigger than the second speed.

* * * * *